US010306934B2

(12) United States Patent
Ichigaya

(10) Patent No.: US 10,306,934 B2
(45) Date of Patent: Jun. 4, 2019

(54) AIR-CONDITIONED CLOTHING FOR USE WITH HELMET

(71) Applicant: SFT LABORATORY CO., LTD., Itabashi-ku, Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 0 days.

(21) Appl. No.: 15/500,920

(22) PCT Filed: Jul. 31, 2014

(86) PCT No.: PCT/JP2014/070215
§ 371 (c)(1),
(2) Date: Jan. 31, 2017

(87) PCT Pub. No.: WO2016/016996
PCT Pub. Date: Feb. 4, 2016

(65) Prior Publication Data
US 2017/0231293 A1 Aug. 17, 2017

(51) Int. Cl.
*A41D 13/002* (2006.01)
*A42B 3/28* (2006.01)
(Continued)

(52) U.S. Cl.
CPC ..... *A41D 13/0025* (2013.01); *A41D 1/005* (2013.01); *A42B 3/003* (2013.01);
(Continued)

(58) Field of Classification Search
CPC ..... A41D 13/0025; A41D 1/005; A41D 2200/20; A42B 3/28; A42B 3/003
See application file for complete search history.

(56) References Cited

U.S. PATENT DOCUMENTS 3,468,299 A * 9/1969 Amato ..... A41D 13/0025 126/204
2007/0050878 A1* 3/2007 Ichigaya ..... A41D 13/0025 2/69

(Continued)

FOREIGN PATENT DOCUMENTS

DE 704407.0 C 3/1941
JP 04159119 A 6/1992

(Continued)

OTHER PUBLICATIONS

International Search Report (ISR) and Written Opinion dated Oct. 14, 2014 issued in International Application No. PCT/JP2014/070215.

(Continued)

*Primary Examiner* — Emmanuel E Duke
(74) *Attorney, Agent, or Firm* — Holtz, Holtz & Volek PC

(57) ABSTRACT

An air-conditioned clothing for use with a helmet which can be used when the helmet is worn as well as when the helmet is not worn, includes a clothing main body, at least one fan, an air blow-out unit, a guide sheet and an attachment unit. The air is made to flow through an air flow path by the at least one fan and the flowing air evaporates sweat coming out from a body to cool the body with heat of evaporation and in a case where the helmet is worn, the air which blows out from the air blow-out unit is guided to the helmet by the guide sheet and taken into the helmet from an air intake which is formed between an inner edge of the helmet and the head of the user in order to circulate the air inside the helmet.

7 Claims, 5 Drawing Sheets

(51) Int. Cl.
*A41D 1/00* (2018.01)
*A42B 3/00* (2006.01)

(52) U.S. Cl.
CPC ..... *A42B 3/28* (2013.01); *A41D 2200/20* (2013.01); *A42B 3/286* (2013.01)

(56) References Cited

U.S. PATENT DOCUMENTS

| | | | | |
|---|---|---|---|---|
| 2007/0271939 | A1* | 11/2007 | Ichigaya ..... | A41D 13/0025 62/259.3 |
| 2012/0137411 | A1 | 6/2012 | Majoros | |

FOREIGN PATENT DOCUMENTS

| | | | |
|---|---|---|---|
| JP | 10280211 | A | 10/1998 |
| JP | 2005054299 | A | 3/2005 |
| JP | 2008054726 | A | 3/2008 |
| WO | 2005063065 | A1 | 7/2005 |

OTHER PUBLICATIONS

International Preliminary Report on Patentability (IPRP) (and English translation thereof) dated Jan. 31, 2017 issued in counterpart International Application No. PCT/JP2014/070215.
Extended European Search Report (EESR) dated Mar. 2, 2018 issued in counterpart European Application No. 14898751.4.

* cited by examiner

AIR-CONDITIONED CLOTHING FOR USE WITH HELMET

TECHNICAL FIELD

The present invention relates to an air-conditioned clothing for use with a helmet that can cool the body by generating an air flow approximately in parallel with the body or underwear surface and that can circulate the air inside a helmet by sending the air into the helmet when the helmet is worn.

BACKGROUND ART

Recently, there has been utilized an air-conditioned clothing which can evaporate the sweat coming out from the body by generating a large flow of outer air that is approximately in parallel with the body or underwear surface. The detail description of the principal and the structure of such air-conditioned clothing are described in the Patent Literature 1, for example. Many of those who wear such air-conditioned clothings also wear helmets. In such case, the humidity in the body area can be resolved by wearing the air-conditioned clothing but the humidity in the head area caused by wearing a helmet cannot be resolved.

Recently, there also has been utilized a device for adding a fanning function to a regular work helmet which fulfills the safety regulation. According to such device, a fan is attached at the outside edge of a helmet so as to send the outer air which is taken in by the fan inside the helmet through an intake pipe.

PRIOR ART DOCUMENT

Patent Document

Patent Literature 1: JP 2005-54299A

SUMMARY OF INVENTION

Problem to be Solved by the Invention

However, such device for adding the fanning function to a work helmet has serious functional problems as described below. First, since the device is directly attached to a helmet, a large fan, in terms of weight, cannot be used. Therefore, a large amount of air cannot be sent inside the helmet and the humidity in the head area cannot be efficiently resolved. Secondly, since the intake pipe is provided in a space between the helmet and the head, the cross-section area of the intake pipe cannot be large. Therefore, the air flow rate needs to be set to a high rate to send a large amount of air inside the helmet in order to efficiently circulate the air in the helmet. However, since the power consumption is proportional to the square of the air flow rate, if the air flow rate is set to a high rate, the battery will be used up quickly.

The present invention was made in view of the above problems and an object is to provide an air-conditioned clothing for use with a helmet which not only resolves the humidity in the body area but also efficiently resolves the humidity in the head area of a user when the helmet is worn.

Means for Solving the Problem

To solve the object described above, the present invention is An air-conditioned clothing for use with a helmet which can be used in both circumstances when the helmet is worn and when the helmet is not worn, including: an clothing main body which at least covers an upper body of a body; one or more fans which are attached to the clothing main body and which form an air flow path between the clothing main body and the body or an underwear by taking in air from outside and forcefully generate an air flow in the air flow path; an air blow-out unit which is formed between back of a neck of a user and a back collar part of the clothing main body and which blows out the air which flows through the air flow path; a guide sheet which is continuously attached to the back collar part of the clothing main body and which guides the air which blows out from the air blow-out unit to the helmet along back of the neck and back of a head of the user; and an attachment unit which is attached to an edge part of the guide sheet and which is used to attach the guide sheet to the helmet, wherein the air is made to flow through the air flow path by the fans and the flowing air evaporates sweat coming out from the body to cool the body with a heat of evaporation and in a case where the helmet is worn, the air which blows out from the air blow-out unit is guided to the helmet by the guide sheet and taken into the helmet from an air intake which is formed between an inner edge of the helmet and the head of the user in order to circulate the air inside the helmet.

In the air-conditioned clothing for use with helmet according to the present invention, the air is made to flow through the air flow path by the fan and the flowing air evaporates the sweat coming out from the body and cools the body of the user due to the heat of evaporation being generated when the sweat evaporates. Further, by including the guide sheet continuously attached to the back collar part of the clothing main body, the air which blows out from the air blow-out unit can be guided to the helmet along back of the neck and back of the head of the user through inner side of the guide sheet when the helmet is worn. Therefore, the air that flows through inner side of the guide sheet can evaporate the sweat coming out from back of the neck and back of the head of the user, and back of the neck and back of the head can be cooled. Further, the air which is guided to the helmet can be efficiently taken into the helmet and the air inside the helmet can be circulated. Therefore, the humidity in the head area of the user can be sufficiently resolved.

Effects of Invention

According to the air-conditioned clothing for use with helmet of the present invention, when the helmet is worn, the air that flows through inner side of the guide sheet can evaporate the sweat coming out from back of the neck and back of the head of the user, and back of the neck and back of the head can be cooled. Further, the air which is guided to the helmet can be efficiently taken in to the helmet and the air inside the helmet can be circulated. Therefore, the humidity in the head area of the user can be sufficiently resolved.

DESCRIPTION OF PREFERRED EMBODIMENTS

Hereinafter, embodiments of the invention according to the present application will be described with reference to the drawings.

First Embodiment

Figure 1A:
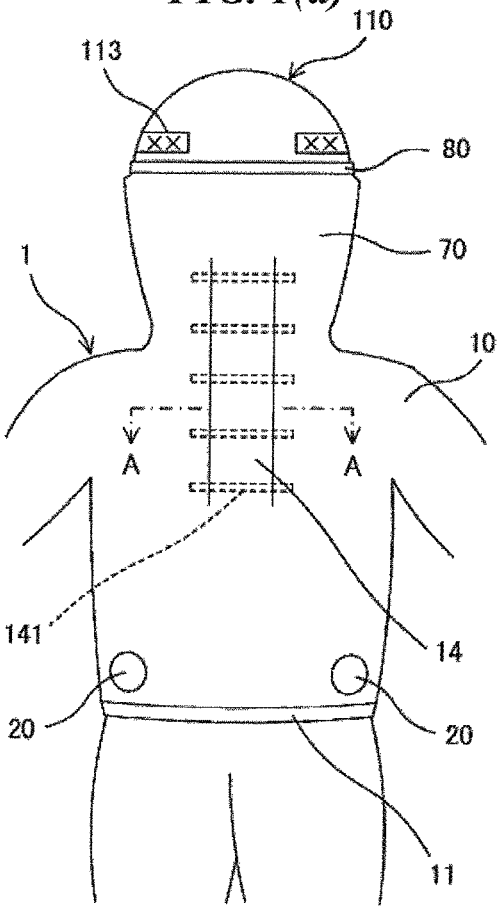
FIG. 1(*a*) is a schematic back view of an air-conditioned clothing for use with helmet according to the first embodiment of the present invention, FIG. 1(*b*) is a schematic side view of the air-conditioned clothing for use with helmet and FIG. 1(*c*) is a partial schematic cross-sectional view of the air-conditioned clothing for use with helmet cut along the line A-A.
Figure 1B:
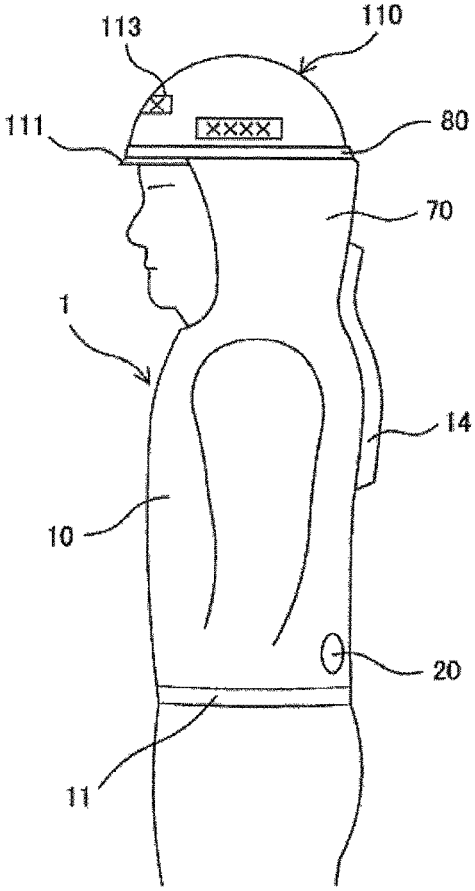
Figure 1C:
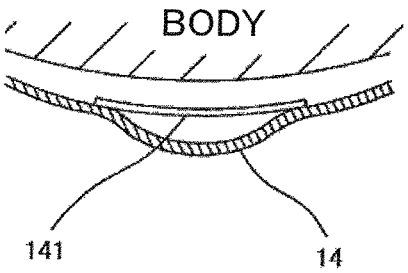
Figure 2:
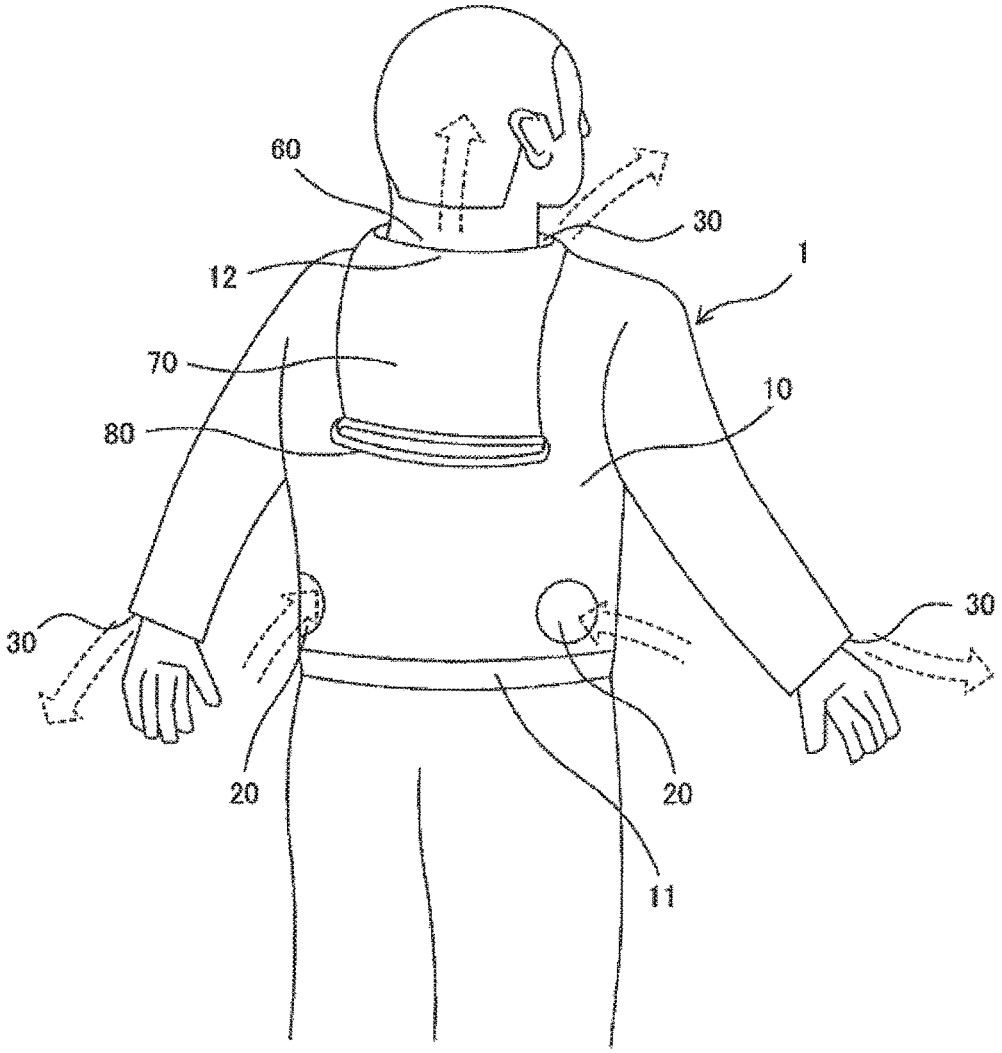
FIG. 2 is a view used for describing the air flow in the air-conditioned clothing for use with helmet.
Figure 3:
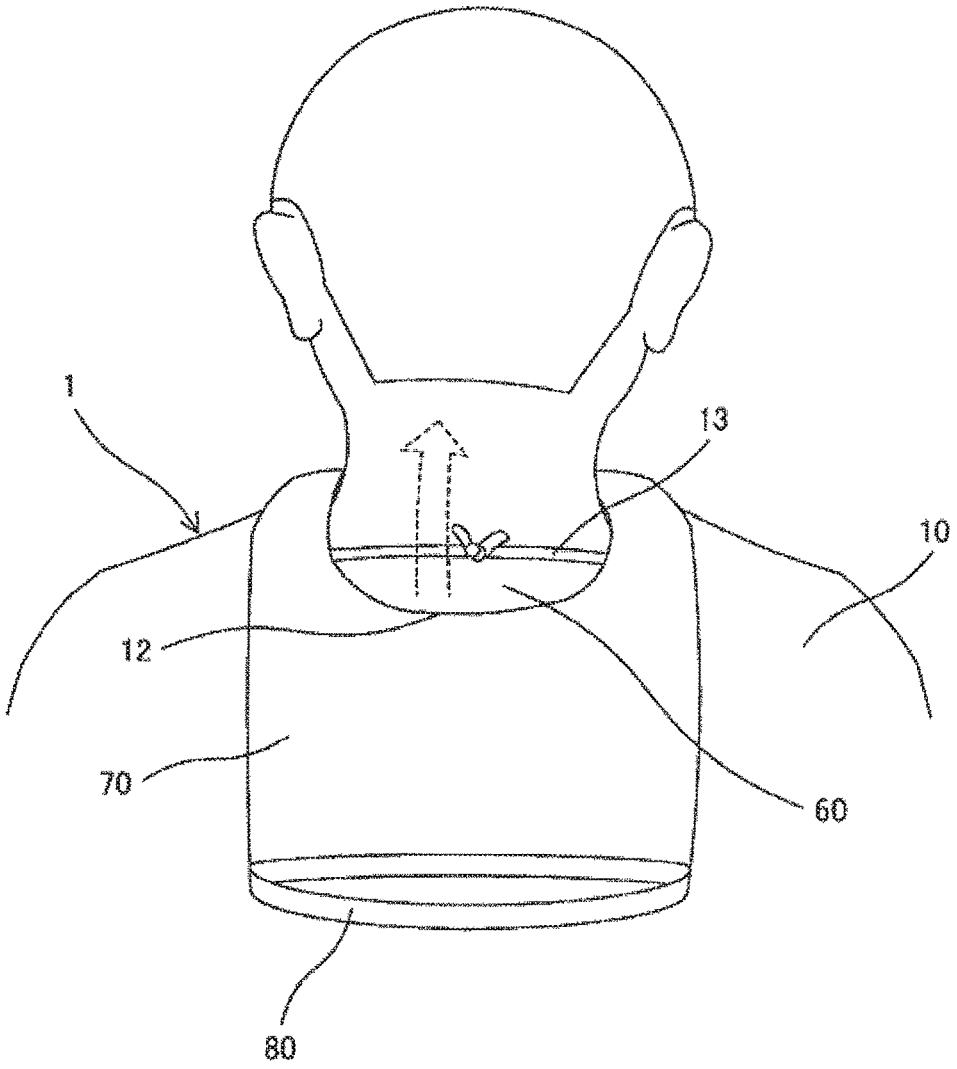
FIG. 3 is a view used for describing an air blow-out unit of the air-conditioned clothing for use with helmet.

First, the first embodiment of the present invention will be described with reference to the drawings. FIG. 1(*a*) is a schematic back view of an air-conditioned clothing for use with a helmet according to the first embodiment of the present invention, FIG. 1(*b*) is a schematic side view of the air-conditioned clothing for use with a helmet and FIG. 1(*c*) is a partial schematic cross-sectional view of the air-conditioned clothing for use with a helmet cut along the line A-A. Further, FIG. 2 is a view used for describing the air flow in the air-conditioned clothing for use with a helmet and FIG. 3 is a view used for describing an air blow-out unit of the air-conditioned clothing for use with a helmet.

The air-conditioned clothing for use with a helmet of the first embodiment can be used in both situations when a helmet is worn and when a helmet is not worn. As shown in FIGS. 1, 2 and 3, the air-conditioned clothing 1 for use with a helmet includes a clothing main body 10, two fans 20 and 20, air outlets 30, a power unit (not shown), a power cable (not shown), an air blow-out unit 60, a guide sheet 70 and an attachment unit 80 for attaching the guide sheet 70 to a helmet 110. Here, FIG. 1 shows a state where the air-conditioned clothing 1 for use with a helmet is worn with the helmet 110 and FIGS. 2 and 3 show states where the air-conditioned clothing 1 for use with a helmet is worn but the helmet is not worn.

The clothing main body 10 is made of a sheet material having very little or no breathability and is formed in a shape that can cover the upper body part and the arm parts. The bottom hem part 11 of the clothing main body 10 has an elastic member such as lubber, for example, attached thereto. In such way, the bottom hem part 11 of the cloth main body 10 is made narrow so as to fit along the body or the underwear. Further, the clothing main body 10 is provided with a zip-up fastener (not shown) as an open/close unit on the front side thereof. The zip-up fastener is used to open and close the front part of the clothing main body 10 when wearing the cloth main body 10.

The fans 20 generate an air flow path between the clothing main body 10 and the body or underwear by taking in the air from outside, and forcefully generate an air flow in the air flow path. The two fans 20 and 20 are respectively attached on the left and right sides at the lower part of the clothing main body 10. Here, as for the fans 20, fans using propellers are used.

Further, the clothing main body 10 is provided with an inner pocket (not shown) for carrying a power unit inside thereof. The power unit is for supplying power to the two fans 20 and 20. As for the power unit, a power device in which a battery is embedded is used, for example. The power unit and the two fans 20 and 20 are electrically connected by the power cable.

The air outlets 30 are for letting out the air which flows through the space (air flow path) between the clothing main body 10 and the body or underwear. In particular, the sleeve parts and the neck part of the clothing main body 10 function as the air outlets 30.

The air-conditioned clothing 1 for use with a helmet of the first embodiment can also be used when the helmet is not worn and not only when the helmet is worn. In the case where the helmet is not worn, if the two fans 20 and 20 are made to operate after a user wears the clothing main body 10 and fastens the zip-up fastener, as shown in FIG. 2, the outer air is taken into the clothing main body 10 from the two fans 20 and 20. Then, the air which is taken in flows upward through the air flow path approximately in parallel with the body and is let out from the neck part and the sleeve parts which are the air outlets 30. While flowing through the air flow path, the air evaporates the sweat coming out from the body and lowers the temperature of the body surface due to the heat of evaporation being generated when the sweat evaporates. Therefore, in order to make the cooling function of the air-conditioned clothing for use with a helmet 1 function efficiently, it is necessary to make the resistance the air flowing through the air flow path receive at the air outlets 30 be small to allow a large amount of air flow approximately in parallel with the body. As a method to realize this, the clothing main body 10 is provided with a set of adjusting strings 13 for enlarging or narrowing the space between back of the neck of the user and the back collar part 12 of the clothing main body 10 as shown in FIG. 3. The ends of the adjusting strings 13 are attached to the inner surface of the back collar part 12 of the clothing main body 10. By tying the set of adjusting strings 13 so as to appropriately adjust their lengths, the size of the opening formed between back of the neck and the back collar part 12 can be adjusted appropriately. Through this large opening, a large amount of air which flows through the air flow path can be blown upward. The opening formed between back of the neck and the back collar part 12 is one of the air outputs 30 and is also the air blow-out unit 60 of the present invention.

In a case where a user wears the air-conditioned clothing 1 for use with a helmet and carries out a regular task, the area of the air blow-out unit 60 is set to about 10 $cm^2$ by adjusting the lengths of the adjusting strings 13. Further, the rotation rate of the two fans 20 and 20 is adjusted so as to take in the air inside the clothing main body 10 from outside at the rate about 20 litters/second. In such case, with respect to the air which is taken in through the two fans 20 and 20 at the rate about 20 litters/second, apart thereof is let out from the sleeve parts and the front neck part at the rate about 12 litters/second and the rest thereof is let out from the air blow-out unit 60 at the rate about 8 litters/second.

Many of those who wear such air-conditioned clothings 1 for use with a helmet also wear helmets. Therefore, if the air which blows out from the air blow-out unit 60 of the clothing main body 10 can be effectively taken into the helmet, the person who wears the air-conditioned clothing 1 for use with a helmet can be relieved from the humidity inside the helmet. Further, since the air which blows out flows along back of the neck, back of the neck and back of the head can also be cooled. Since the air-conditioned clothing 1 for use with a helmet of the first embodiment includes the guide sheet 70 and the attachment unit 80, the air which blows upward from the air blow-out unit 60 of the clothing main body 10 can be taken in to the helmet along back of the neck. That is, the air-conditioned clothing 1 for use with a helmet is provided with a function to circulate the air inside the helmet.

Here, with respect to the air-conditioned clothing 1 for use with a helmet, it is designed so that the air which is taken in to the clothing main body 10 inflates the clothings main body 10, and the air flow path is formed between the clothing main body 10 and the body or underwear due to the inflation of the clothing main body 10. Therefore, especially in the back part of the clothing main body 10, the air also flows through the part far from the body and such air does not contribute to evaporating the sweat coming out from the body. Thus, the air which blows out from the air blow-out unit 60 is not degraded in terms of temperature and humidity and is still sufficiently maintains an effective condition for evaporating the sweat coming out from the body.

The guide sheet 70 is for guiding the air which blows out from the air blow-out unit 60 into the helmet 110 by guiding the air along back of the neck and back of the head. One end of the guide sheet 70 is connected to the back collar part 12 of the clothing main body 10. That is, the clothing main body 10 and the guide sheet 70 are formed as one. Actually, as shown in FIG. 1, the guide sheet 70 is in the shape of a hood of a raincoat or the like except the top part of the hood where covers the top of the head is removed.

Figure 4:
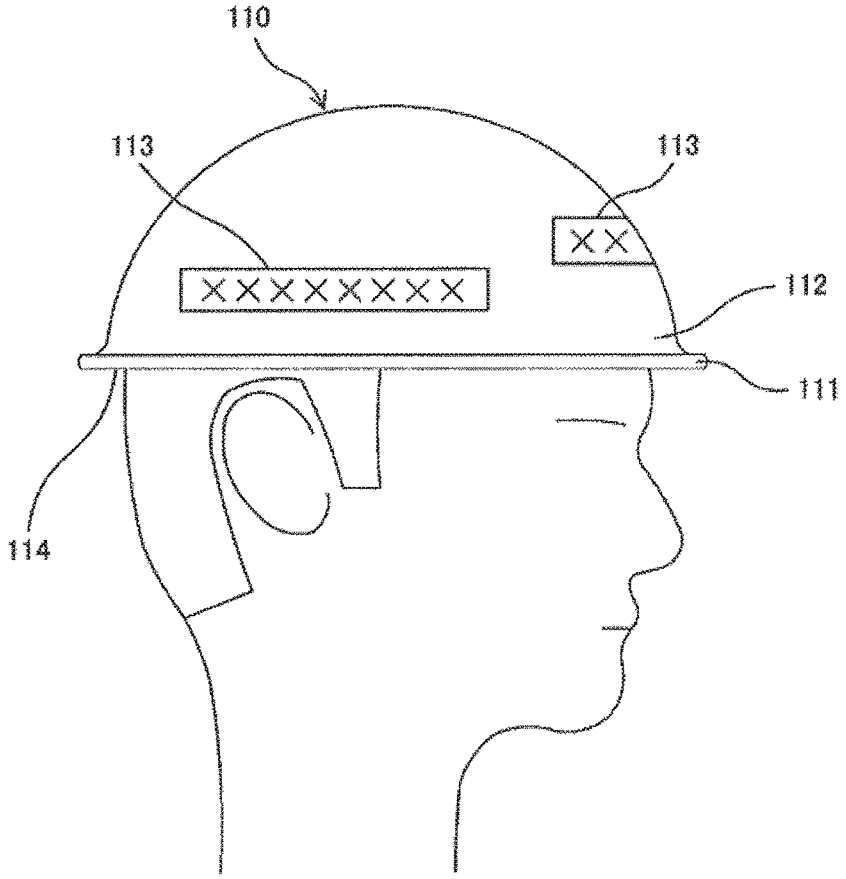
FIG. 4 is a schematic side view showing a user wearing a regular work helmet.

On the other hand, the attachment unit 80 is attached to the edge part of the guide sheet 70. The attachment unit 80 is for attaching the guide sheet 70 to the helmet 110. Here, as shown in FIGS. 2 and 3, an elastic loop belt is used as the attachment unit 80. FIG. 4 is a schematic side view showing a user wearing a regular work helmet. As shown in FIG. 4, a regular work helmet 110 includes a flange 111. As shown in FIG. 1(*b*), the loop belt which is the attachment unit 80 is fit around the edge circumference 112 along the flange 111 of the helmet 110.

By the way, as shown in FIG. 4, the written information 113 such as the name, the company name, the work content and the like of the person who wears the helmet 110 is usually shown on the outside surface of the helmet 110. Such written information 113 is important in terms of safety during work and the like. In the first embodiment, the width of the belt which is the attachment unit 80 is made to be narrow as possible so as not to cover the written information 113. In particular, the size of the belt which is the attachment unit 80 is designed so that the rate of the outer surface of the helmet 110 that is covered by the attachment unit 80 when the attachment unit 80 is attached to the helmet 110 be 20% of the entire surface of the helmet 110 at the most.

As described above, the air blow-out unit 60 is an opening formed between back of the neck of the user and the back collar part 12 of the clothing main body 10, and the air which flows through the air flow path blows out toward the guide sheet 70 via the air blow-out unit 60. In the first embodiment, since the clothing main body 10 and the guide sheet 70 are formed as one, although the position of the air blow-out unit 60 cannot be clearly specified, it can be considered that the air blow-out unit 60 is the part of the clothing main body 10 corresponding to back of the neck of the user in terms of definition.

Further, as shown in FIG. 1, the clothing main body 10 is provided with a loose section 14, the section being formed so as to make this section of the clothing main body 10 loose, at the upper back part thereof along the section from the fans 20 to the air blow-out unit 60. Here, as shown in FIG. 1(*a*), the part where the loose section 14 is formed corresponds to the range extending in the up and down directions at the upper back part of the clothing main body 10, that is, in the range from the center back part of the clothing main body 10 to the center part of the guide sheet 70. In particular, the two sides of the loose section 14 are sewed onto the clothing main body 10 with five loosening strings 141. In such way, when the outside air is taken into the clothing main body 10 by the fans 20, the loose section 14 inflates toward outside of the clothing main body 10 by the air which is taken in.

Next, the using method of the air-conditioned clothing 1 for use with a helmet when the helmet 110 is worn will be described.

The user first wears the clothing main body 10 and then wears the helmet 110. Thereafter, the user lifts up the guide sheet 70 of the air-conditioned clothing 1 for use with a helmet so as to cover back of the neck and back of the head, and fit the loop belt which is the attachment unit 80 around the edge circumference 112 of the helmet 110. In such way, the user can easily attach the guide sheet 70 to the helmet 110.

If the fans 20 and 20 are made to operate, the outer air is taken into the air flow path of the air-conditioned clothing 1 for use with a helmet from the fans 20 and 20 and flows toward the sleeve parts (air outlets 30) and the air blow-out unit 60. In the first embodiment, since the clothing main body 10 is provided with the loose section 14 at the upper back part thereof along the section from the fans 20 to the air blow-out unit 60, the loose section 14 inflates when the fans 20 and 20 are made to operate and a large amount of air can be gathered at this loose section 14. That is, as shown in FIG. 1(*c*), the loose section 14 becomes a wind guide path whose cross-section area is larger than the cross-section areas of other parts where the air flows. Therefore, the large amount of air gathered here can be guided to the air blow-out unit 60 from the loose section 14 as the wind guide path. Further, since the guide sheet 70 is connected to the back collar part 12 of the clothing main body 10, the large amount of air that blows out from the air blow-out unit 60 can be efficiently guided to the helmet 110 along the guide sheet 70 and can be taken into the helmet 110 from the air intake 114 (see FIG. 4) which is formed between the inner edge of the helmet 110 and the head of the user. In such way, by taking in the air inside the helmet 110, the air inside the helmet 110 can be circulated.

Here, since the clothing main body 10 is provided with the loose section 14 at the upper back part thereof in the first embodiment, a sufficient area of the air blow-out unit 60 can be assured when the fans 20 and 20 are made to operate. Therefore, the air-conditioned clothing 1 for use with a helmet does not necessarily need to include the adjusting strings 13.

With respect to the air-conditioned clothing for use with a helmet of the first embodiment, the air is made to flow through the air flow path by using the fans, the flowing air evaporates the sweat coming out from the body and the body of the user can be cooled due to the heat of evaporation being generated when the sweat evaporates. Further, since the guide sheet is continuously attached to the back collar part of the clothing main body, the air which blows out from the air blow-out unit can be guided to the helmet along back of the neck and back of the head of the user through inner side of the guide sheet. Therefore, the air which flows along inner side of the guide sheet can evaporate the sweat coming out from back of the neck and back of the head of the user, and back of the neck and back of the head can be cooled. Further, since the air guided to the helmet can be efficiently guided into the helmet to circulate the air inside the helmet, the humidity in the head area of the user can be sufficiently resolved.

Further, in the first embodiment, the clothing main body is provided with the loose section which is formed so as to make this part of the clothing main body loose at the upper back part thereof along the section from the fans to the air blow-out unit. Therefore, when the air is made to flow through the air flow path by the fans being operated, the loose section inflates and a large amount of air can be gathered at the loose section. Thus, the large amount of air gathered here can be guided to the air blow-out unit from the loose section, and the amount of air guided to the helmet can be increased.

Further, in the first embodiment, the rate of the outer surface of the helmet that is covered by the attachment unit when the attachment unit is attached to the helmet is 20% of the entire surface of the helmet at the most. Therefore, the written information such as the name, the company name and the like of the person who wears the helmet that is shown on the outer surface of the helmet can be avoided from being completely covered by the attachment unit and being unrecognizable by other workers.

Figure 5:
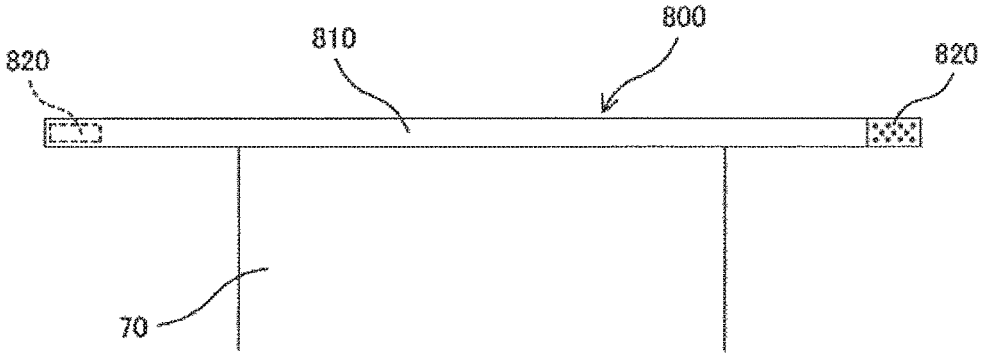
FIG. 5 is a schematic front view showing a modified example of the attachment unit of the air-conditioned clothing for use with helmet according to the first embodiment.

In the first embodiment, a case where an elastic loop belt is used as the attachment unit is described. However, the attachment unit is not limited to the above described configuration and may have any other configuration as long as the attachment unit is attached around the edge circumference of the helmet and can be tightened around the edge circumference. FIG. 5 is a schematic front view showing a modified example of the attachment unit of the air-conditioned clothing for use with a helmet according to the first embodiment. As shown in FIG. 5, the attachment unit 800 of the modified example includes a belt 810 which is attached at the edge part of the guide sheet 70 and which is approximately in parallel with the edge part and two sheet type fasteners (engaging units which engage with each other) 820 and 820 attached at two ends of the belt 810. As for the belt 810, a belt made of a transparent flexible polyvinyl chloride is used. Since the flexible polyvinyl chloride belt 810 fits with and tightly attaches to the surface of the helmet, the attachment unit 800 can be firmly attached to the helmet. Further, since the belt 810 is transparent, other workers can recognize the written information even if the belt 810 overlaps the written information when the attachment unit 800 is attached to the helmet. In such aspect, under normal circumstances, it is preferred that the attachment unit of the air-conditioned clothing for use with a helmet is transparent.

Further, as for the attachment unit, a unit which includes elastic strings attached to the edge part of the guide sheet and two hooks (engaging units which engage with each other) which are attached to the tips of the strings can also be used. In such case, by wrapping the strings around the edge circumference of the helmet and engaging the two hooks with each other, the guide sheet can be attached to the helmet. Further, as for the attachment unit, an elastic loop string which is attached to the edge part of the guide sheet can also be used.

Further, with respect to the modified example of the attachment unit shown in FIG. 5, the length of the belt of the attachment unit can be shortened. In such case, the sheet fasteners are to be attached at the positions on the sides of the helmet that face the sheet fasteners attached to the two ends of the belt in advance and by attaching the sheet fasteners at the ends of the belt to the sheet fasteners on the helmet, the guide sheet can be attached to the helmet. In such way, the length of the attachment unit does not necessarily need to have the length that goes around the edge circumference of the helmet.

Second Embodiment

Figure 6A:
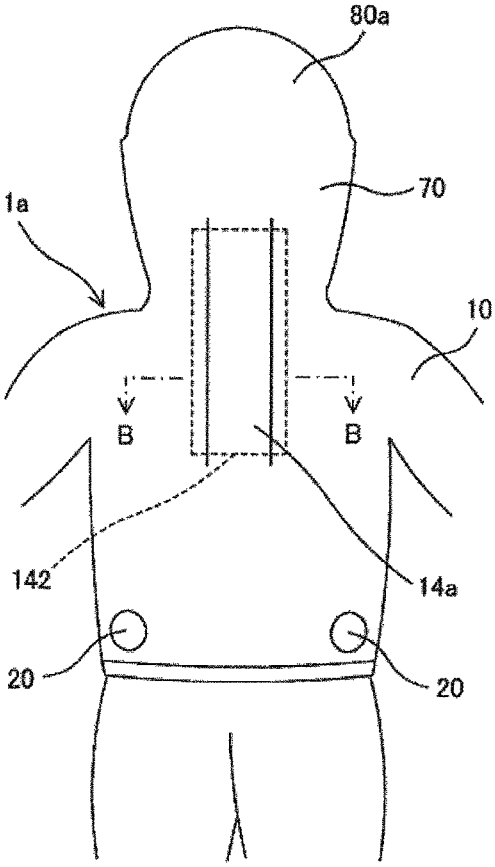
FIG. 6(*a*) is a schematic back view of an air-conditioned clothing for use with helmet according to the second embodiment of the present invention, FIG. 6(*b*) is a schematic side view of the air-conditioned clothing for use with helmet and FIG. 6(*c*) is a partial schematic cross-sectional view of the air-conditioned clothing for use with helmet cut along the line B-B.
Figure 6B:
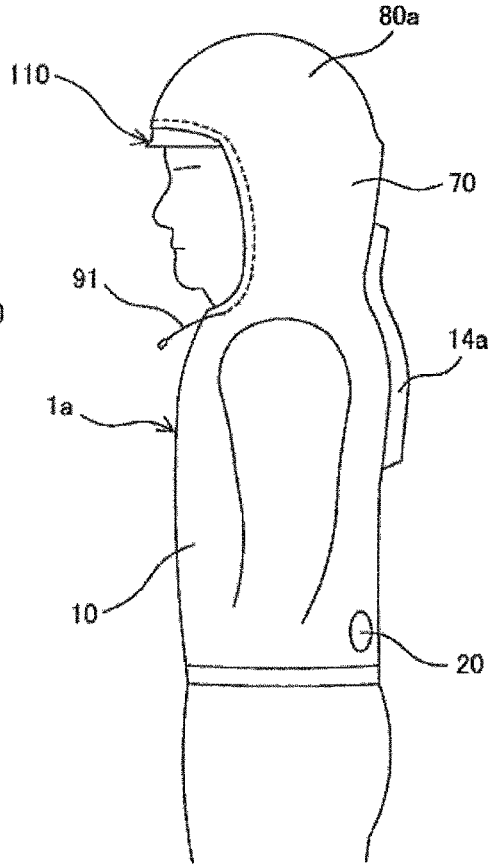
Figure 6C:
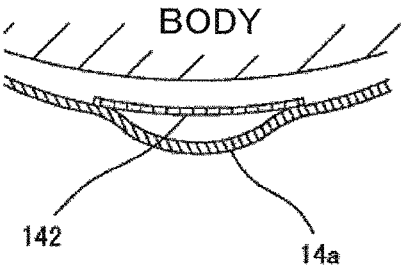

Next, the air-conditioned clothing for use with a helmet according to the second embodiment of the present invention will be described. FIG. 6(*a*) is a schematic back view of the air-conditioned clothing for use with a helmet according to the second embodiment of the present invention, FIG. 6(*b*) is a schematic side view of the air-conditioned clothing for use with a helmet and FIG. 6(*c*) is a partial schematic cross-sectional view of the air-conditioned clothing for use with a helmet cut along the line B-B. Here, in the second embodiment, the same symbols are used for the parts having the same functions as those in the first embodiment and the description thereof is omitted.

As shown in FIG. 6, the air-conditioned clothing 1*a* for use with a helmet of the second embodiment includes the clothing main body 10, two fans 20 and 20, air outlets 30, a power unit (not shown), a power cable (not shown), an air blow-out unit 60, a guide sheet 70 and an attachment unit 80*a* for attaching the guide sheet 70 to a helmet 110. Here, the clothing main body 10 is provided with the loose section 14*a* which is formed so as to make this part of the clothing main body 10 loose at the upper back part thereof along the section from the fans 20 to the air blow-out unit 60.

The first aspect of the air-conditioned clothing 1*a* for use with a helmet of the second embodiment which differs from that of the first embodiment is that the cover unit having an approximately half sphere shape which is continuously attached to the edge part of the guide sheet 70 and which covers approximately the entire helmet when the helmet is worn is used as the attachment unit 80*a*. Therefore, the attachment unit 80*a* and the guide sheet 70 as a whole form a hood.

As shown in FIG. 6(*b*), the hood is provided with a hood adjusting string 91 at the edge part thereof for adjusting the size of the opening of the hood. After wearing the hood over the helmet 110, the user pulls the hood adjusting string 91. By appropriately pulling the hood adjusting string 91, the hood can firmly fit the helmet 110 and the space between the helmet 110 and the hood can be made small. Therefore, since the amount of the air going out from the space between the helmet 110 and the hood can be reduced, the air which blows out from the air blow-out unit 60 can be efficiently taken in to the helmet 110. Here, the hood adjusting string 91 can be omitted.

The second aspect of the air-conditioned clothing 1*a* for use with a helmet of the second embodiment which differs from that of the first embodiment is that the loose section 14*a* is formed by sewing an approximately rectangle shaped cloth 142 for making this section loose to the clothing main body 10, the vertical length of the rectangle shaped cloth 142 being approximately the same as the vertical length of the loose section 14*a*. Here, as for the material of the cloth 142 for making the section loose, a coarse mesh material is used. By forming the loose section 14*a* with the approximately rectangle shaped cloth 142 for making this section loose, the loose section 14*a* be in a continuously inflated state and the air flow path of the air-conditioned clothing 1*a* for use with a helmet will have a better appearance when seen from outside.

The air-conditioned clothing for use with a helmet of the second embodiment has the same effects and advantages as those of the air-conditioned clothing for use with a helmet of the first embodiment.

Other Embodiment

The present invention is not limited to the above described embodiments and various modifications can be carried out within the scope of the invention.

For example, in the above described embodiments, cases where the clothing main body is provided with two fans are described. However, the clothing main body may be provided with three or more fans in order to increase the amount of air which is to be taken into the helmet. Further, the clothing main body may also be provided with only one fan.

In the above described embodiments, cases where the clothing main body is formed in a shape which covers the upper body are described. However, the clothing main body can be formed in a shape that covers the upper body and the lower body, for example. Under normal circumstances, the clothing main body can be formed in any shape as long as it at least covers the upper body.

In the above described embodiments, cases where the air-conditioned clothing for use with a helmet is used when a helmet is worn are mainly described. However, it is needless to say that the air-conditioned clothing for use with a helmet of the present invention can be used even when a helmet is not worn. In such case, the air-conditioned clothing for use with a helmet can be worn in a state where its guide sheet and attachment unit are hung down from the back collar part.

INDUSTRIAL APPLICABILITY

As described above, according to the air-conditioned clothing for use with a helmet of the present invention, the air which flows through inner side of the guide sheet can evaporate the sweat coming out from back of the neck and back of the head of the user when a helmet is worn, and back of the neck and back of the head can be cooled. Further, since the air which is guided to the helmet can be efficiently taken into the helmet and the air inside the helmet can be circulated, the humidity in the head area of the user can be sufficiently resolved. Therefore, the air-conditioned clothing for use with a helmet of the present invention can be preferably used in the case especially where the user works at a work site or the like with a helmet on.

DESCRIPTION OF REFERENCE NUMERALS

1, 1*a* air-conditioned clothing for use with a helmet
10 clothing main body
11 bottom hem part
12 back collar part
13 adjusting string
14, 14*a* loose section
141 loosening string
142 cloth for making the section loose
20 fan
30 air outlet
60 air blow-out unit
70 guide sheet
80, 80*a*, 800 attachment unit
810 belt
820 sheet fastener (engaging units which engage with each other)
91 hood adjusting string
110 helmet
111 flange
112 edge circumference
113 written information
114 air inlet

The invention claimed is:

1. An air-conditioned clothing for use with a helmet, which can be used when the helmet is worn as well as when the helmet is not worn, the air-conditioned clothing comprising:

a clothing main body which at least covers an upper body of a body;

at least one fan which is attached to the clothing main body and which forms an air flow path between the clothing main body and a body or an underwear by taking in air from outside and forcefully generating an air flow in the air flow path;

an air blow-out unit which is formed between a back of a neck of a user and a back collar part of the clothing main body and which blows out the air which flows through the air flow path;

a guide sheet which is continuously attached to the back collar part of the clothing main body and which guides the air which blows out from the air blow-out unit to the helmet along the back of the neck and back of a head of the user; and an attachment unit which is attached to an edge part of the guide sheet and which is used to attach the guide sheet to the helmet, wherein the air is made to flow through the air flow path by the at least one fan and the flowing air evaporates sweat coming out from the body to cool the body with heat of evaporation and in a case where the helmet is worn, the air which blows out from the air blow-out unit is guided to the helmet by the guide sheet and taken into the helmet from an air intake which is formed between an inner edge of the helmet and the head of the user in order to circulate the air inside the helmet, and wherein the clothing main body includes a loose section at an upper back part thereof along a section from the at least one fan to the air blow-out unit, a range of the loose section extending from a center back part of the clothing main body onto the guide sheet, and the loose section being formed so as to make the clothing main body loose at the loose section and so that a distance between the loose section and the body or the underwear is larger than a distance between an area of the clothing main body other than the loose section and the body or the underwear, when the air is made to flow through the air flow path by the at least one fan.

2. The air-conditioned clothing of claim 1, wherein the attachment unit comprises an elastic loop belt or a string attached to the edge part of the guide sheet.

3. The air-conditioned clothing of claim 1, wherein the attachment unit includes a belt which is attached at the edge part of the guide sheet and which is approximately parallel with the edge part and two engaging units which are attached at two ends of the belt and which engage with each other.

4. The air-conditioned clothing of claim 1, wherein an outer surface of the helmet that is covered by the attachment unit when the attachment unit is attached to the helmet is at most 20% of an entire surface of the helmet.

5. The air-conditioned clothing of claim 1, wherein the attachment unit is transparent.

6. The air-conditioned clothing of claim 1, wherein the attachment unit is continuously attached to the edge part of the guide sheet and covers approximately an entirety of the helmet when the helmet is worn.

7. The air-conditioned clothing of claim 1, wherein the range of the loose section extends from the center back part of the clothing main body to a center part of the guide sheet.

* * * * *